US007192181B2

(12) United States Patent
Schmiedchen

(10) Patent No.: US 7,192,181 B2
(45) Date of Patent: Mar. 20, 2007

(54) TIMEPIECE INCLUDING A MECHANISM FOR TRIGGERING A TIME-RELATED FUNCTION AND SIMULTANEOUS WINDING OF A BARREL SPRING

(75) Inventor: Christian Schmiedchen, Reichstädt (DE)

(73) Assignee: Glashütter Uhrenbetrieb GmbH, Glashütte/Sachsen (DE)

( * ) Notice: Subject to any disclaimer, the term of this patent is extended or adjusted under 35 U.S.C. 154(b) by 230 days.

(21) Appl. No.: 10/472,220

(22) PCT Filed: Mar. 21, 2001

(86) PCT No.: PCT/EP01/03346

§ 371 (c)(1),
(2), (4) Date: Sep. 22, 2003

(87) PCT Pub. No.: WO02/077723

PCT Pub. Date: Oct. 3, 2002

(65) Prior Publication Data

US 2004/0090872 A1 May 13, 2004

(51) Int. Cl.
*G04B 1/12* (2006.01)

(52) U.S. Cl. ..... 368/140; 368/101

(58) Field of Classification Search ..... 368/139, 368/140, 145, 101, 110
See application file for complete search history.

(56) References Cited

U.S. PATENT DOCUMENTS

| | | | | | |
|---|---|---|---|---|---|
| 2,062,895 | A * | 12/1936 | Lux | ..... | 368/264 |
| 2,113,274 | A * | 4/1938 | Lux | ..... | 368/99 |
| 2,798,358 | A * | 7/1957 | Heim | ..... | 368/265 |
| 3,460,339 | A * | 8/1969 | Schneider | ..... | 368/247 |
| 3,479,813 | A * | 11/1969 | Kocher | ..... | 368/142 |
| 3,543,506 | A * | 12/1970 | Dubois et al. | ..... | 368/106 |
| 4,363,553 | A * | 12/1982 | Thomi et al. | ..... | 368/140 |
| 6,406,176 | B1 * | 6/2002 | Takahashi et al. | ..... | 368/101 |
| 6,698,918 | B2 * | 3/2004 | Durand | ..... | 368/324 |
| 2005/0122844 | A1 * | 6/2005 | Ruchonnet | ..... | 368/76 |

FOREIGN PATENT DOCUMENTS

| | | | | |
|---|---|---|---|---|
| CH | 295 436 | | 12/1953 | |
| CH | 372989 | * | 11/1959 | |
| CH | 372 989 | | 7/1963 | |
| CH | 527455 | * | 12/1968 | |
| CH | 527 455 | | 1/1972 | |
| CH | 672 868 | | 1/1990 | |
| EP | 1333345 | A1 * | 8/2003 | ..... 368/110 |
| FR | 1 421 930 | | 3/1966 | |

OTHER PUBLICATIONS

Translation of CH527455, Fred Bandi,Morat.*
Translation of CH372989, D Ebauches Unitas.*
International Search report completed Aug. 3, 2001 and mailed Aug. 10, 2001 in PCT/EP 01/03346.

* cited by examiner

*Primary Examiner*—Tulsidas C. Patel
*Assistant Examiner*—Jeanne-Marguerite Goodwin
(74) *Attorney, Agent, or Firm*—Griffin & Szipl, P.C.

(57) ABSTRACT

The invention concerns a timepiece component comprising a watch movement provided with a main barrel acting as power source for a timekeeping device of the watch movement and an auxiliary barrel designed to supply mechanical power to an additional device, and mechanical control means capable of being manually actuated to trigger said additional device, characterised in that said control means are arranged to simultaneously trigger the additional device and wind the auxiliary barrel.

18 Claims, 3 Drawing Sheets

TIMEPIECE INCLUDING A MECHANISM FOR TRIGGERING A TIME-RELATED FUNCTION AND SIMULTANEOUS WINDING OF A BARREL SPRING

This is a National Phase Application in the United States of International Patent Application No. PCT/EP01/03346 filed Mar. 21, 2001. The entire disclosure of the above patent application is hereby incorporated by reference.

BACKGROUND OF THE INVENTION

The present invention concerns a timepiece including a mechanism for triggering a time-related function and simultaneous winding of a barrel spring. More particularly, the invention concerns a timepiece of this type wherein the mechanism winds a barrel spring intended to activate a striking-work mechanism at the expiry of a predetermined time interval counted down by a timer mechanism connected to the timekeeping device of the timepiece. "Timer mechanism" means a device counting down a predetermined time interval.

There are already known in the prior art mechanical devices that ring on demand or automatically, for example to strike the hours in the case of watches provided with minute-repeater mechanisms, or to wake someone at a certain time in the case of alarm-watches. Conventionally, the energy necessary to activate the hammers of the striking work is provided from a striking work barrel via a gear train, the striking work barrel being distinct from the motor barrel, which provides the energy to the timekeeping module of the movement, and conventionally having its own winding device.

Two types of winding devices for the striking work barrel are generally found, depending upon whether it is for an alarm-watch or a watch with a minute-repeater mechanism. In alarm-watches, the striking work barrel is conventionally wound via its own winding or time-setting stem, the striking work being triggered at a given moment by a trigger device which then enables the barrel to provide its energy to the hammer until the striking work barrel is completely let down. One drawback of this type of arrangement lies in the fact that the user can select an alarm time and activate the alarm function without the barrel necessarily being wound, so that it is possible that the striking work is not triggered at the selected alarm time if the barrel is totally let down. In watches with minute-repeater mechanisms, the striking work barrel is conventionally wound by means of a slide-button which slides over the external surface of the watch-case and which is mechanically connected, through an oblong aperture, to a sliding block with a rack arm co-operating with the striking work barrel. The time indication is given by strikes activated by the mechanism immediately after having released the slide-button. One drawback of these slide-button mechanisms is that their construction is complex, cumbersome and generally does not ensure water-resistance without an additional device for sealing and locking the slide-button which complicates the handling thereof. Such a mechanism is for example disclosed in CH Patent No. 672 868. Another drawback of this type of mechanism lies in the fact that it does not enable energy to be stored in the striking work barrel in order to trigger the mechanism at any time.

SUMMARY OF THE INVENTION

It is a main object of the present invention to overcome the drawbacks of the aforementioned prior art by providing a timepiece including a mechanism triggering a time function and simultaneous winding of a barrel spring, said mechanism having a simple and compact construction.

It is also an object of the invention to provide a timepiece of the type described hereinbefore, and in particular a wristwatch, wherein the control means for the mechanism can be integrated in the watchcase without affecting the water-resistance of the latter.

It is also an object of the invention to provide a timepiece of the type described hereinbefore wherein the control means include a control member of the conventional type.

It is also an object of the invention to provide a timepiece of the type described hereinbefore including a mechanism that simultaneously winds the striking work barrel and triggers an additional device, for example a timer mechanism, without disturbing the operation of the timepiece's timekeeping device.

The invention therefore concerns a timepiece including a watch movement provided with a main barrel acting as power source for a timekeeping device of the watch movement and an auxiliary barrel provided to supply mechanical energy to an additional device, and mechanical control means capable of being activated manually to trigger said additional device, characterised in that said control means are arranged for simultaneously triggering the additional device and winding the auxiliary barrel.

Owing to these features, the auxiliary barrel that supplies mechanical energy to the additional device is systematically wound when it is triggered so that the user no longer has to worry about the state of winding of the barrel. Utilisation of the timepiece is thus also simplified for the user. This construction is also advantageous from the point of view of compactness and cost, insofar as it allows two functions to be controlled using the same control means.

According to a preferred embodiment of the invention, the additional device includes a striking work associated with a timer mechanism connected to the timekeeping device of the watch movement, the striking work being triggered at the end of a time interval counted down by the timer mechanism.

According to an advantageous feature of the invention, the control means include a push-button. The use of a conventional push-button to wind the auxiliary barrel easily resolves the problems of water-resistance encountered with control members for auxiliary barrels of the slide-contact type of the prior art. Moreover, since the push-buttons are easily available on the market, costs linked to development of a new control member are also eliminated. Owing to this feature, the manufacture of this timepiece in the form of a water-resistant wristwatch is also simplified.

BRIEF DESCRIPTION OF THE DRAWINGS

Other features and advantages of the present invention will appear in the following description of a preferred embodiment, given by way of non-limiting example with reference to the annexed drawings, in which.

DETAILED DESCRIPTION OF THE INVENTION

Figure 1:
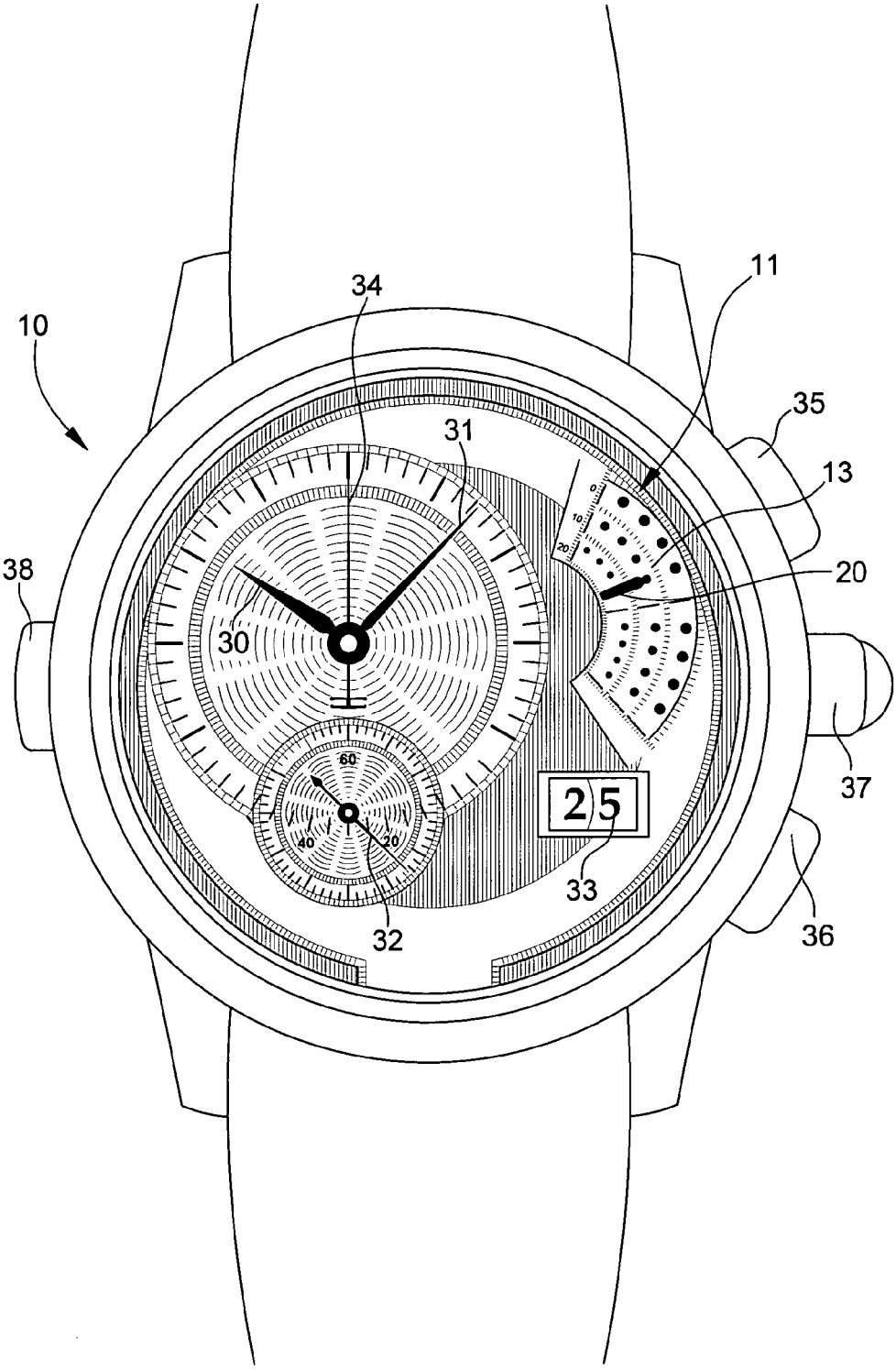
FIG. 1 is a top view of a timepiece according to the invention.

FIG. 1 is a top view of a timepiece 10 of the wristwatch type conventionally including a watch movement including the invention. This timepiece 10 includes an hour hand 30, a minute hand 31 and a small second hand 32 respectively driven by a timekeeping device of the watch movement. The timekeeping device is conventionally supplied with energy by a main barrel. A large aperture date device 33 completes the readings provided by the timekeeping device. Watch 10 shown here further includes a second hand 34 and a minute counter 11 assuring a chronograph function. Hand 34 and counter 11 are started and stopped by means of a first push-button 35, whereas a second push-button 36 resets said indicators 34 and 11 to zero. A crown 37, depending upon the axial positions into which it is brought, winds a main barrel acting as energy source for the timekeeping device, sets the date and sets the time of the timekeeping device hands.

The timepiece according to the invention further includes an additional device that uses minute counter 11, and which is supplied with energy at least in part by an auxiliary barrel BA (FIG. 2) arranged in the watch movement. In the example illustrated, the additional device includes a striking work mechanism associated with a timer mechanism 100 that is kinematically connected to the timekeeping device of the watch movement, the striking work being triggered at the end of a pre-selected time interval, which is counted down by the timer mechanism. Auxiliary barrel BA thus supplies the mechanical energy necessary to activate the hammers of the striking work mechanism, which will not be described in more detail here, whereas the main barrel supplies the mechanical energy necessary to drive the timer. Pre-selection of the length of time to be counted down is set by rotating crown 37 which, via a gear train (not shown), acts on a hand 19 with three branches of different lengths and offset angularly at 120°. Only one of the branches is shown in FIG. 1. The three branches co-operate with a dial 13 in the shape of a circular sector including three concentric scales each of 10 minutes.

According to the invention, watch 10 includes mechanical control means MC including a push-button 38 located at around 9 o'clock and which are arranged to simultaneously trigger the additional device and wind auxiliary barrel BA. For this purpose, control means MC further include a lever 40 pivoted at A on the plate of the movement (not shown) for controlling the triggering of the additional device and a winding bar 42, which extends across the movement between push-button 38 and auxiliary barrel BA to wind the latter. Push-button 38 simultaneously acts on lever 40 and on winding bar 42 via an articulated lever 43 inserted between lever 40 respectively winding bar 42 and end 38*a* of the stem of push-button 38. The travel of the push-button is designated by length L in FIG. 2. In the example illustrated, lever 43 has the shape of a strip substantially curved in the plane. Lever 43 is articulated at B on the movement plate by one of its ends in a known manner. Lever 43 further includes three pins 44, 45 and 46 distributed over its length and which extend perpendicularly to its surface. Two of these pins 44 and 45 act respectively as points of support for the transmission of the movement of lever 43 to lever 40 and to winding bar 42. The third pin 46 acts as a point of support for a return spring 47 that tends to cause lever 43 to pivot in the direction of arrow F. In the example illustrated, pin 45, which acts on winding bar 42, also forms a point of support for the end 38*a* of the stem of push-button 38.

It goes without saying that, by way of variant, one could envisage omitting articulated lever 43 and associating a part (not shown) including two fingers cooperating respectively with lever 40 and winding bar 42, with the stem of push-button 38.

Figures 3, 4:
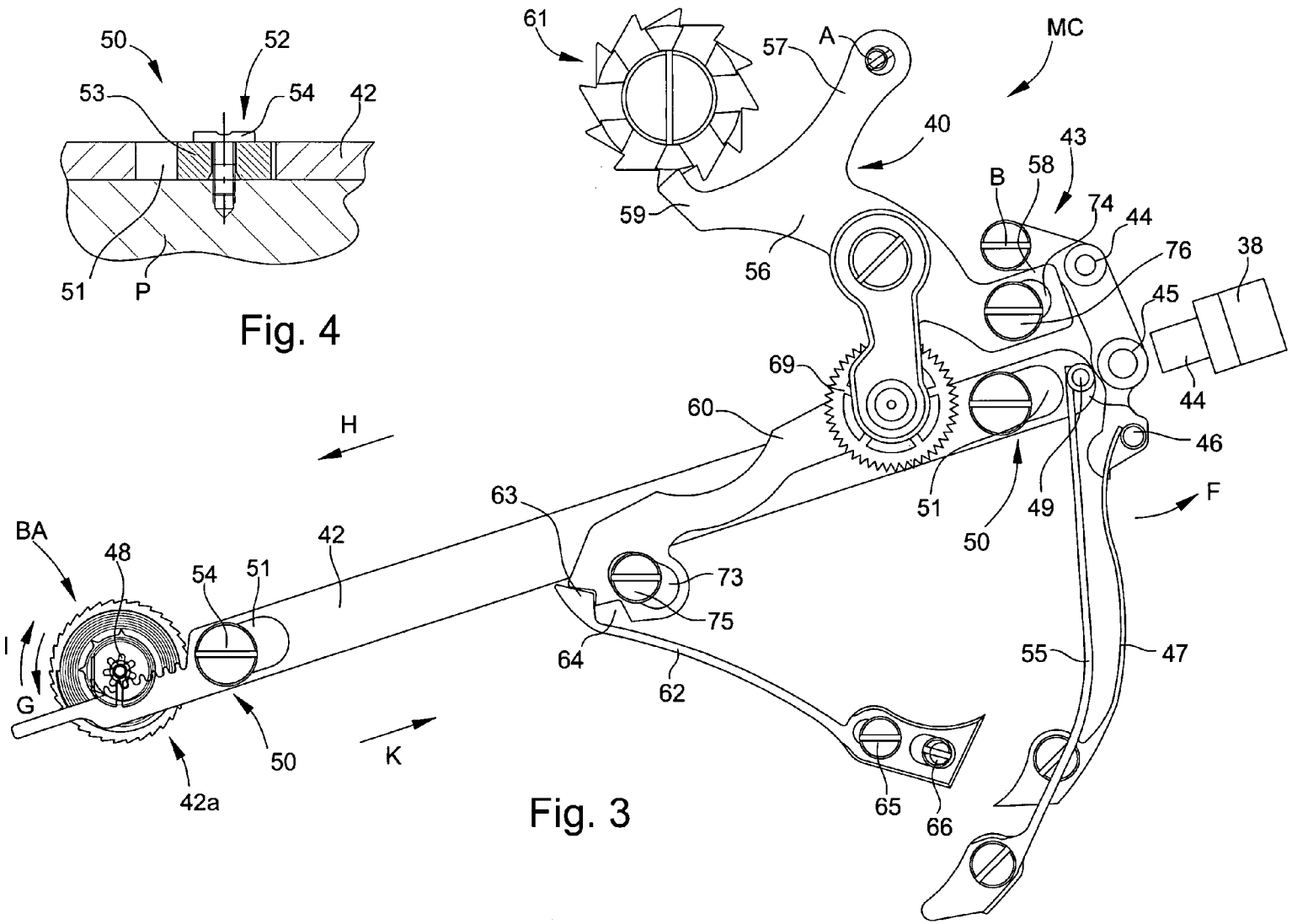
FIG. 4 shows a partial cross-section of the guide means for one component of the control means of a timepiece according to the invention.

Winding bar 42 has, at its distal end, a rack 42*a* which meshes with a pinion 48, connected to the shaft of auxiliary barrel BA, whereas its proximal end co-operates with articulated lever 43. Winding bar 42 extends along a direction parallel to the movement of push-button 38 and is preferably aligned along the longitudinal direction thereof. In order to assure a movement of translation of bar 42 in the direction of arrow H when push-button 38 is actuated, bar 42 is associated with translation guide means 50. One detail of these guide means 50 is shown in FIG. 4. These guide means 50 include in the illustrated example two oblong holes 51 arranged respectively at the opposite ends of bar 42 and each associated with a stud 52 secured to plate P of the movement. Preferably, and in order to ensure precise guiding of the bar with a minimum of friction, studs 52 are formed of a stone or jewel with a large hole 53, for example a ruby, held flat on the plate by a screw 54. A movement of translation of winding bar 42 via the action of push-button 38 via lever 43 drives pinion 48 in the direction of arrow I which winds the spring of auxiliary barrel BA. In the example described, once the action on push-button 38 has been released, bar 42 remains in place in an end of travel position in which the spring of auxiliary barrel BA is completely wound (FIG. 3).

It will be noted in this regard, that a travel L of the order of 1 mm by bar 42 causes a rotation by pinion 48 of the order of 180° and that this rotation provides sufficient winding to power the additional device, a striking work mechanism in the example described.

Figure 2:
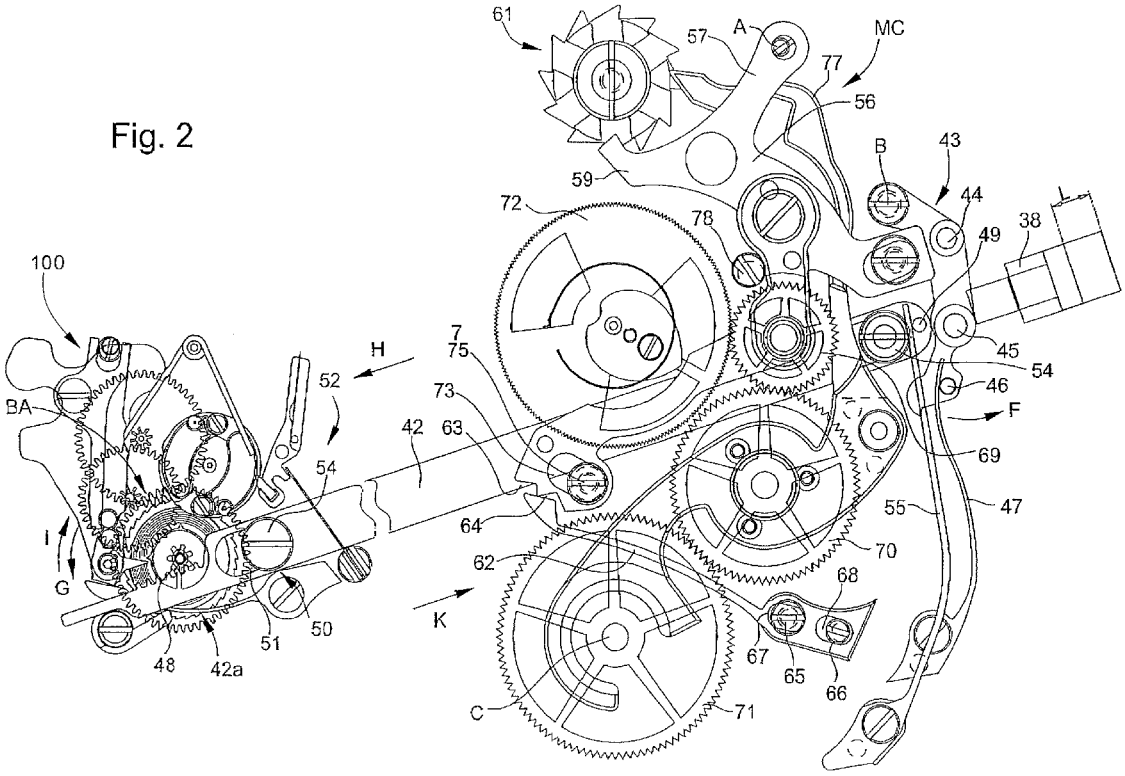
FIGS. 2 and 3 are respectively detailed plan views of the controlled means, shown in two operating positions and seen from the opposite side to the dial, of a timepiece according to the invention.

This wound position is maintained until the striking work is triggered, at which point the spring of auxiliary barrel BA is released to actuate the striking work, thereby driving pinion 48 meshed with the rack in the direction of arrow G and thus returning bar 42 to its rest position in which the spring of barrel BA is completely let down (FIG. 2). The return of bar 42 to the rest position is assisted by a return spring 55, which acts in the direction of arrow K on a pin 49 driven into bar 42.

Control lever 40 of the additional device includes a body 56 from which extend four arms 57, 58, 59 and 60. Lever 40 is articulated in a conventional manner at the end of a first arm 57 on the plate of the movement. The free end of a second arm 58 extends facing pin 44 of lever 43. A third arm 59 co-operates with a column wheel 61 controlled by a device (not shown) connected to push-buttons 35 and 37 (FIG. 1). A fourth arm 60 co-operates via its free end with a jumper spring 62, which indexes two pre-defined positions of lever 40. In order to achieve such indexing, the free end of fourth arm 60 includes two notches 63 and 64 in which the end of jumper spring 62 engages.

It will be noted in this regard that the tension of jumper spring 63 and its position with respect to notches 63 and 64 are adjustable by means of a screw 65 and a cam 66 respectively co-operating with two oblong holes 67 and 68 arranged in one end of spring 62. Arm 60 further carries a reversing wheel 69 permanently meshing with a chronograph wheel 70 which is carried by a lever of chronograph 77 pivoted at C (FIG. 2) and which in turn meshes with a wheel 71 whose shaft carries small second hand 32. Depending upon the position of lever 40, the reversing wheel is engaged or released from a wheel 72, which drives the chronograph second hand anticlockwise.

It will be noted that the free ends of arms 58 and 60 each include an oblong hole 73, 74 associated with a stud 75, 76 in order to ensure precise guiding of lever 40 and to hold it against the plate.

It will also be noted that in the particular example, column wheel 61 is arranged to lock lever 40 in a position in which reversing wheel 69 is released from wheel 72 when the chronograph function is triggered and to lock chronograph lever 77 in a position in which wheel 70 is released from wheel 72 when the timer function is triggered. Finally, lever 40 co-operates with an cam shaped stop, which allows adjustment of the depth of penetration of the teeth of reverser wheel 69 in the toothing of chronograph second wheel 72.

The invention claimed is:

1. A timepiece, including:

a watch movement provided with a main barrel acting as energy source for a timekeeping device of the watch movement, a display for current time, driven by the timekeeping device, and an auxiliary barrel provided to supply mechanical energy to an additional device, and mechanical control means able to be actuated manually to trigger said additional device, wherein the main barrel is wound independently from the auxiliary barrel, and wherein said control means for said additional device are arranged to simultaneously trigger the additional device and wind the auxiliary barrel.

2. A timepiece according to claim 1, wherein the additional device includes a striking work associated with a timer mechanism connected to the timekeeping device of the watch movement, the striking work being triggered at the end of a time interval counted down by timer mechanism.

3. A timepiece according to claim 2, wherein the auxiliary barrel supplies energy to the striking work.

4. A timepiece according to claim 1, wherein said control means include a push-button.

5. A timepiece according to claim 4, further comprising a chronograph gear train, wherein said control means further include a lever carrying a reversing wheel meshed with a wheel of the chronograph gear train and a winding bar provided with a rack kinematically connected to the spring of the auxiliary barrel, and wherein said push-button simultaneously acts on said lever and said winding bar.

6. A timepiece according to claim 5, wherein an articulated control lever is inserted between said lever respectively the winding bar and the push-button, said lever being associated with a return spring.

7. A timepiece according to claim 6, wherein the lever is mobile in rotation between a first position in which the reversing wheel is meshed with a wheel of the timer mechanism gear train, and a second position in which the reversing wheel is released from said wheel.

8. A timepiece according to claim 4, further comprising a winding bar and an articulated control lever, wherein the winding bar and the articulated control lever are respectively associated with return springs.

9. A timepiece according to claim 5, wherein the lever is mobile in rotation between a first position in which the reversing wheel is meshed with a wheel of the timer mechanism gear train, and a second position in which the reversing wheel is released from said wheel.

10. A timepiece according to claim 5, wherein the winding bar is associated with translation guide means.

11. A timepiece according to claim 10, wherein the winding bar moves along a direction parallel to the movement of the push-button.

12. A timepiece according to claim 11, wherein the winding bar is aligned along the longitudinal direction of the push-button.

13. A timepiece according to claim 12, wherein the guide means include a pair of oblong holes spaced at a distance from each other and arranged in the bar, associated with a pair of studs secured to a plate of the movement.

14. A timepiece according to claim 10, wherein the guide means include a pair of oblong holes spaced at a distance from each other and arranged in the bar, associated with a pair of studs secured to a plate of the movement.

15. A timepiece according to claim 14, wherein each stud is formed of a stone with a large hole screwed flat onto said plate.

16. A timepiece according to claim 11, wherein the guide means include a pair of oblong holes spaced at a distance from each other and arranged in the bar, associated with a pair of studs secured to a plate of the movement.

17. A timepiece according to claim 5, wherein said lever includes four arms, a first arm via which said lever is articulated on a plate of the movement, a second arm co-operating with said control lever, a third arm co-operating with a column wheel, and a fourth arm co-operating with a jumper spring that allows two predetermined positions of said lever to be indexed.

18. A timepiece according to claim 17, wherein an end of the fourth arm includes two notches in which an end of said jumper spring can be engaged.

* * * * *